US005906709A

United States Patent [19]

Vezzani

[11] Patent Number: 5,906,709

[45] Date of Patent: May 25, 1999

[54] PROCESS FOR PRODUCING FIBERS FROM VEGETABLE RAW MATERIALS USING A THIN AND HEATED TURBULENT LAYER

[75] Inventor: Corrado Vezzani, Milan, Italy

[73] Assignee: Vomm Chemipharma S.R.L., Milan, Italy

[21] Appl. No.: 08/769,707

[22] Filed: Dec. 18, 1996

[30] Foreign Application Priority Data

Dec. 20, 1995 [IT] Italy ..... MI95A2680

[51] Int. Cl.[6] ..... D21C 3/26

[52] U.S. Cl. ..... 162/17; 162/19; 162/92; 162/97

[58] Field of Search ..... 162/92, 97, 99, 162/17, 19

[56] References Cited

U.S. PATENT DOCUMENTS

| | | | |
|---|---|---|---|
| 2,487,114 | 11/1949 | Dreyfus | 162/97 |
| 3,332,836 | 7/1967 | Lowgren et al. . | |
| 3,620,911 | 11/1971 | Eklund et al. | 162/97 |
| 4,997,488 | 3/1991 | Gould et al. | 127/37 |

FOREIGN PATENT DOCUMENTS

| | | |
|---|---|---|
| 538 653 | 4/1993 | European Pat. Off. . |
| 2300149 | 3/1976 | France . |
| 2639370 | 5/1990 | France . |
| 2628221 | 5/1978 | Germany . |

*Primary Examiner*—Peter Chin
*Assistant Examiner*—Dean T. Nguyen
*Attorney, Agent, or Firm*—Ostrolenk, Faber, Gerb & Soffen, L.L.P.

[57] ABSTRACT

A process for producing cellulose from vegetable raw materials containing same by reacting these with digesting agents is described, comprising a preliminary size reduction of said raw materials to give a pumpable material, and a heat treatment of said material, arranged in a thin layer and maintained in a state of high turbulence, with at least one digesting agent; the abovementioned treatment is preferably carried out in a turboreactor and produces a mixture of cellulose fibres and of spent digesting agent, from which cellulose fibres ready for the uses in the paper industry are obtained via subsequent washing and separation phases; the process described is particularly suitable for the production of cellulose from annual plants in high yields, in very short times and at costs substantially reduced as compared with known processes.

13 Claims, 2 Drawing Sheets

PROCESS FOR PRODUCING FIBERS FROM VEGETABLE RAW MATERIALS USING A THIN AND HEATED TURBULENT LAYER

FIELD OF THE INVENTION

In its most general aspect, the present invention relates to a process for the production of cellulose.

In particular, the invention concerns a process for the continuous production of cellulose from vegetable materials containing same, and especially from annual plants.

BACKGROUND OF THE INVENTION

It is known that the consumption of paper and cardboard is constantly and progressively increasing throughout the world and that there is an increasingly urgent need to resort to sources of supply for cellulose as raw material for paper manufacture other than those hitherto used traditionally, that is to say plants with a wooden stem such as conifers, broadwoods etc., also with consideration of the adverse environmental impact connected with the massive felling of forest trees.

For this reason, various studies of the possibilities of using annual plants such as wheat, sorghum, maize, hemp etc. in the production of cellulose have been carried out in recent years.

The major problem encountered with the use of annual plants in the production of cellulose is represented by their low density and consequently the enormous volumes of raw material which must be transported from the growing fields to the paper mills.

This entails such an increase in costs that, from an economic point of view, the use of annual plants as sources of cellulose is rendered unsuitable, which per se already give yields lower than those obtainable with the use of plants with a wooden stem, when they are worked according to the processes conventionally used in paper mills.

These latter are by themselves already characterized by a low profitability, since they are based on the use of now technologically obsolete equipment. Moreover, the equipment of conventional paper mills is necessarily of considerable size and involves very high installation costs.

The abovementioned problem of the high transport costs could be overcome by locating production units for the extraction of cellulose in the vicinity of the places where the plants are grown. However, because of the high investment required for the construction of a conventional paper mill plant, it would be difficult to propose locating a plurality of production units in the vicinity of places where the plants are grown.

SUMMARY OF THE INVENTION

The problem underlying the present invention is that of providing a process for the production of cellulose from vegetable materials containing same, and in particular annual plants, which process makes it possible to avoid the drawbacks demonstrated above with respect to the state of the art.

Such a problem is solved according to the invention by a process for the production of cellulose from vegetable raw materials containing same, comprising a preliminary size reduction of said raw materials to give a pumpable material, which process is characterized in that it comprises a heat treatment of said material, arranged in a thin layer and maintained in a state of high turbulence, with at least one digesting agent.

According to a further characteristic of the invention, the said treatment is effected by causing said pumpable material to flow continuously in a thin and turbulent layer in contact with a heated wall.

Advantageously, the process of this invention is effected by using an apparatus comprising a cylindrical tubular body with horizontal axis, closed at the opposite ends and fitted with a heating jacket, with inlet and discharge openings for the material to be treated and the material treated respectively, with openings for the introduction of the digesting agents and a bladed rotor which is rotatably mounted in the cylindrical body and caused to rotate at a peripheral velocity of 20–40 meters per second.

When a turboreactor of the abovementioned type is used, the process of this invention is characterized in that it comprises the following phases:

feeding a continuous stream of said pumpable material to a turboreactor comprising a cylindrical tubular body with horizontal axis, provided with openings for introducing said at least one digesting agent and for discharging the final product, a heating jacket for bringing the inside wall of said tubular body to a temperature of 200–300° C., and a bladed rotor rotatably mounted in the cylindrical tubular body where it is set in rotation at a velocity in the range from 20 to 40 meters/second, in order to disperse said continuous stream of pumpable material to give a stream of particles, centrifuging said particles against the heated inside wall of the turboreactor to form a thin tubular and dynamic layer, in which the particles are mechanically maintained in a state of high turbulence by the blades of said bladed rotor, causing said thin tubular dynamic layer to advance towards the discharge opening of the turboreactor, causing it to flow substantially in contact with said heated inside wall thereof, and feeding said turboreactor with a continuous stream of at least one digesting agent, substantially in cocurrent with said thin tubular and dynamic layer of particles and in interaction with these.

Preferably, the abovementioned digesting agent is in aqueous solution and is selected from the group comprising sodium hydroxide, calcium hydroxide, sodium metabisulphite and mixtures thereof.

The solution of digesting agent is fed to the turboreactor from the inlet because in such a way the bladed rotor provides for its efficacious atomization and centrifugation, thereby ensuring that it is introduced in a highly dispersed state into the thin turbulent dynamic layer of particles of material to be treated.

In this way, the most intimate contact possible between the particles and the digesting agent is favoured, and this makes it possible greatly to enhance the effectiveness of the treatment.

In some cases, it can turn out to be appropriate to inject the digesting agent also into other zones of the turboreactor; for this purpose, the inside wall thereof can be provided with openings for the atomization of solutions of digesting agent at various levels along the length of the cylindrical tubular body.

The quantity of digesting agent used in the process according to the invention (dry weight) is preferably between 5 and 10% by weight relative to the dry weight of the vegetable material to be treated.

The solutions of the digesting agents must have a concentration such that they give rise, in the interior of the turboreactor, to a mixture with the material to be treated, which shows a ratio between dry substance and water of between 1:3 and 1:5.

The mean residence time of the material to be treated in the interior of the turboreactor is generally between 30 and 60 seconds.

In some cases, in which the extraction of the lignin and of other substances bound to the cellulose turns out to be particularly difficult, it can prove useful to feed the product stream from the turboreactor continuously to a second turboreactor.

In such a turboreactor, in which the experimental conditions (the temperature of the inside wall, velocity of the bladed rotor) are essentially the same as above, but without any further addition of digesting agent, the completion of the reactions caused by the digesting agent occurs within a mean residence time of 5–10 minutes.

At this stage, it can prove useful to inject a small flow of steam at a pressure of 2–5 atmospheres in cocurrent with the product entering.

This has the purpose of avoiding the formation of encrustations due to hardening of the lignin.

Both in the case in which the vegetable material undergoes a single treatment in only one turboreactor and in the case in which it is subjected to two successive treatments in two turboreactors, the final product is passed to successive conventional phases of washing, separation of the cellulose fibres from the spent digesting fluid, commonly referred to by the term. "black liquor", bleaching and drying.

BRIEF DESCRIPTION OF THE DRAWINGS

The advantages and characteristics of this invention will be further clarified by the description of an embodiment example of a process for the production of cellulose from vegetable material containing same, which is given below with reference to the drawings attached for indicative purposes, in which.

DETAILED DESCRIPTION OF THE INVENTION

Figure 1:
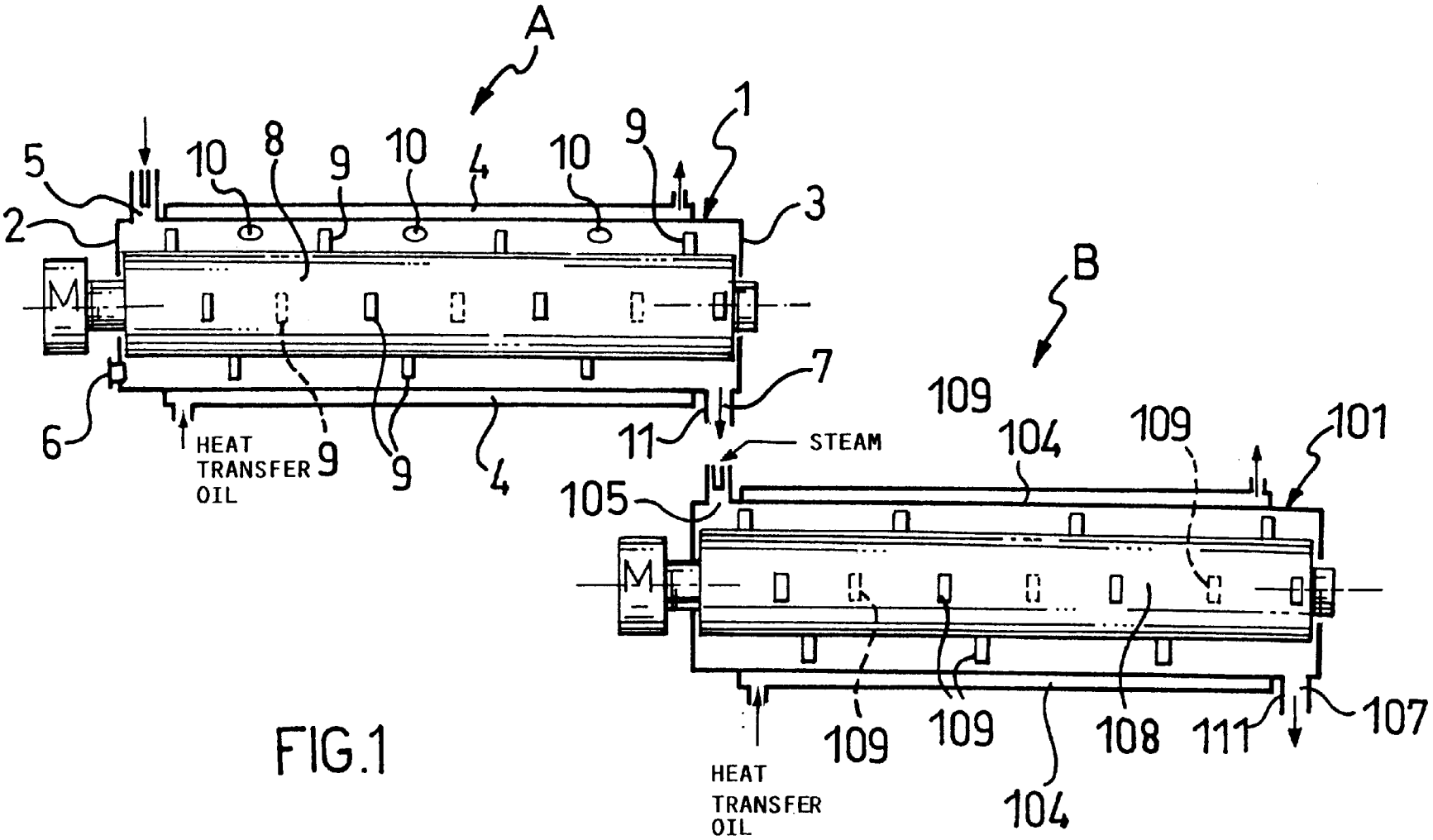
FIG. 1 diagrammatically shows apparatus for carrying out the process according to the invention, and FIG. 2 diagrammatically shows a complete plant for the production of cellulose according to the process of the invention.

With reference to FIG. 1, the apparatus used for the process according to the invention comprises a first unit which, in the following description, will be called turboreactor A, and a second unit which below is called turboreactor B.

The turboreactor A essentially consists of a cylindrical tubular body 1 which is closed at the opposite ends by end pieces 2, 3 and is fitted coaxially with a heating jacket 4, through which a fluid, for example heat transfer oil, is to flow in order to maintain the inside wall of the body 1 at a preset temperature.

The tubular body 1 is provided with inlet openings 5, 6 for the pumpable vegetable material to be treated and the digesting agent used respectively, as well as a discharge opening 7 for the mixture of vegetable material treated and the spent digesting agent.

In the tubular body 1, a bladed rotor 8 is rotatably mounted, whose blades 9 are arranged helically and are oriented for centrifuging and simultaneously conveying the reactants and, respectively, the products of the reaction towards the outlet.

A motor M is provided for driving the bladed rotor at variable peripheral velocities from 20 to 40 meters/second.

In the inside wall of the tubular body 1, there are openings 10 for the injection of digesting agent in atomized form.

When the reaction which has occurred in the turboreactor A needs to be completed, the discharge opening 7 of the turboreactor. A is in communication, along a pipe 11, with the inlet opening 105 of a second turboreactor B, which will not be described in detail since its structure is entirely similar to the turboreactor A described further above. The components of the turboreactor B, which are the same as those of the turboreactor A, are indicated by, the same reference numerals with 100 added.

Figure 2:
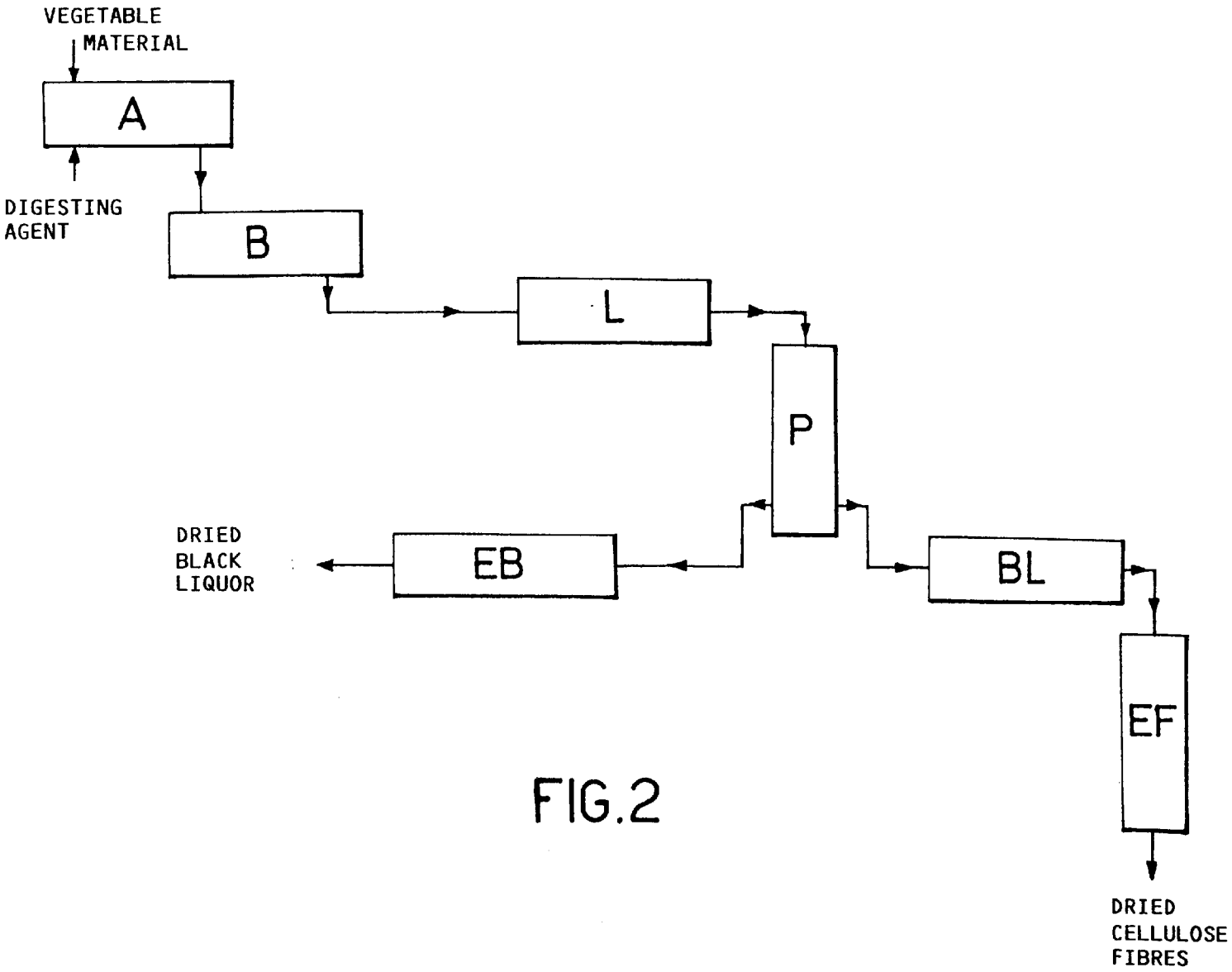

With reference to FIG. 2, a plant for the production of cellulose according to the process of the invention comprises the turboreactor A and the turboreactor B described above, a washer L, a twin-screw press P, a dryer EB for the black liquor, a bleaching unit or bleacher BL and a dryer EF for the cellulose fibres.

EXAMPLE

A turboreactor A with a tubular cylindrical body 1 of 220 mm internal diameter, in which the bladed rotor is caused to rotate at a velocity of 1000 rpm and in which the inside wall is maintained at a controlled temperature of around 280° C., is continuously fed with a stream of ground wheat straw (dimensions of about 2 cm length) at a rate of 10 kg/h. At the same time, 30/h of a 2.5% (weight/volume) solution of NaOH are continuously fed through the orifice 6 and the openings 10.

At the inlet of the turboreactor A, the stream of ground straw is immediately dispersed mechanically into minute particles which are at once centrifuged against the inside wall of the said turboreactor, where they form a thin tubular dynamic layer.

At the same time, the aqueous sodium hydroxide solution, entering via the opening 6, is finely atomized mechanically by the blades 9 of the rotor 8, which also provide for immediate centrifugation of the extremely small droplets obtained. These are introduced in this way into the thin tubular dynamic layer of straw particles with which they can "interact".

The sodium hydroxide solution introduced in atomized form via the openings 10 further increases the interaction of the digesting agent with the straw particles.

After a residence time of about 40 seconds in the turboreactor 1, the reaction product, consisting of a mixture of cellulose fibres and of spent digesting agent, is continuously discharged from the opening 7.

The reaction product is continuously fed to the turboreactor B of 350 mm internal diameter, through the opening (105) in cocurrent with a flow of steam at a pressure of 3.5 bar and at a rate of 40 kg/h.

In the turboreactor B, the wall temperature is controlled at a value of 260° C., while the speed of the bladed rotor is maintained at a constant 700 rpm.

In this second turboreactor B, the interaction between the sodium hydroxide and the straw particles is completed, and the subsequent separation of the cellulose fibres from the black liquor is facilitated, the constituents of the straw, in particular the lignin, which tend to encrust the cellulose being maintained in a softened state owing to the flow of steam.

After a residence time of about 6 minutes, a product consisting essentially of cellulose and a black liquor consisting of a solution of sodium hydroxide containing resins, encrusting substances, lignin and the like, is continuously discharged through the orifice 107.

This product is passed to a washer L where it is washed with three parts by weight of water at a temperature of 95–100° C. and subsequently to a separator of the twin-screw press P type in which the cellulose fibres are separated from the black liquor.

The resulting yield of cellulose fibres relative to the straw fed is equal to 38%, calculated as dry material.

The black liquor can be dried in the dryer EB and used as fuel or as a raw material in the adhesives industry.

On the other hand, the cellulose fibres can be passed to a bleaching phase for treatment with hydrogen peroxide or other bleaching agents in a bleacher BL and finally dried in a drier EF.

The steam generated in the dryers EB and EF can in part be fed to the turboreactor B and to the washer L and in part be condensed and reused for preparing the digesting agent solutions.

All the abovementioned working steps following the reactions carried out in the turboreactors A and B can advantageously be carried out in continuously operating equipment.

In particular, it is possible to use, in place of the conventional dryers for the cellulose fibre (EF) and for the black liquor (EB), turbodryers of the type of the products from the same Applicant.

In the same way, it is possible to replace the conventional bleachers BL by turboreactors identical to those described above.

The traditionally used washers L can also be replaced by turbowashers.

With the use of such equipment, it is possible to operate the process of producing cellulose from vegetable raw materials in a much more profitable and flexible manner than with equipment of the state of the art.

Above all, the continuous working thus made possible assures a higher overall efficiency due to the absence of dead times during working, and higher production rates.

Moreover, the equipment used for carrying out the process according to the invention and the successive phases which lead to cellulose fibres being obtained which are ready for use in the manufacture of paper, cardboard and the like, is characterized by dimensions which are definitely reduced as compared with conventional equipment and leads to installation costs which are reduced to about one-tenth of those foreseeable for a traditional plant.

This makes more than realistic the supposition of installing a plurality of productive units corresponding to the places of production of the vegetable raw material.

In this way, the problem, described above, of the high costs connected with the transport of the raw materials derived from annual plants or vegetable wastes from the place of cultivation to the paper mill can be solved and the way to an extensive use of annual plants or vegetable wastes in the production of cellulose can thus be opened, with clear advantages from the point of view of not only economics but also protection of the environment.

A further great advantage connected with the process according to the invention is that of reduced quantities of water required for carrying it out, equal to about one tenth of that necessary for carrying out the corresponding known processes.

This is made possible owing to the intimate contact achieved between the particles of vegetable raw material and the digesting agents in the interior of the thin tubular dynamic layer which is created in the turboreactors by the effect of the intense mechanical action of the bladed rotor.

Owing to the said mechanical action, also in the presence of a reduced quantity of water, the particles are equally enabled to come homogeneously and intimately into contact with the molecules of the digesting agent.

An advantage connected with the reduced consumption of water is the very greatly reduced, or almost zero, production of effluents.

The invention thus conceived is amenable to variants and modifications, all covered by the scope of protection applying thereto. It remains to state that the fundamental critical condition of the process of this invention for the production of cellulose consists of the thermal treatment of vegetable material made pumpable in a thin and dynamic layer with at least one digesting agent, and that many variants can be applied at the level of the starting vegetable material, of the digesting agents used, of the chemico-physical parameters in play in the process and of the structural characteristics of the equipment, all as a function of particular and contingent requirements.

I claim:

1. A process for producing cellulose fibers from vegetable raw materials containing cellulose comprising the steps:

a. reducing the size of said raw materials to provide a pumpable material, b. flowing said material continuously in a thin and turbulent layer while simultaneously heating said flowing material and introducing into said flowing material at least one digesting agent wherein steps (a.) and (b.) are operated so as to produce cellulose fibers from the vegetable raw materials.

2. A process for producing cellulose fibers from vegetable raw materials containing cellulose comprising the steps:

a. reducing the size of said raw materials to provide a pumpable material, b. feeding a continuous stream of said pumpable material into a turboreactor having walls which form a cylindrical tubular body provided with inlet and outlet openings at opposite ends thereof, c. providing bladed rotor means for pumping said material at a peripheral velocity in the range of 20–40 meters/second through said turboreactor between said inlet and outlet openings thereof.

d. heating said turboreactor walls to a temperature in the range of 200–300° C., e. flowing said material against the heated walls of said turboreactor, thus forming said material into a heated, turbulent, tubular layer, f. introducing at least one digesting agent into said turboreactor to intermix with said layer, and g. flowing said layer containing said at least one digesting agent to and out of said discharge opening wherein steps (a.)–(g.) are operated so as to produce cellulose fibers from the vegetable raw materials.

3. A process according to claim 2 wherein said turboreactor's tubular body has a central axis oriented horizontally, the heating step is conducted using a heating jacket adjacent and outward of said walls of said tubular body, and the flowing of said material in said body is carried out by centrifuging said material against the inside wall surfaces of said tubular walls.

4. A process according to claim 2 wherein said at least one digesting agent is in aqueous solution and is selected from the group comprising sodium hydroxide, calcium hydroxide, sodium metabisulphite and mixtures thereof.

5. A process according to claim 2 wherein the mean residence time of the materials within the turboreactor of about 30–60 seconds.

6. A process according to claim 2 comprising the further steps of feeding the material discharged from said turboreactor into a second similar turboreactor and treating said material introduced into said second turboreactor similarly as in said first turboreactor but with a mean residence time of the materials within said second turboreactor of about 5–10 minutes.

7. A process according to claim 6 comprising the further step of introducing into said second turboreactor a continuous flow of steam at a pressure of 2–5 atmospheres substantially concurrently with said thin tubular and dynamic layer flow in interaction therewith.

8. A process for producing cellulose fibers from vegetable raw materials containing cellulose comprising the steps:

a. reducing the size of said raw materials to provide a pumpable material, b. feeding a continuous stream of said pumpable material into a turboreactor having walls which form a cylindrical tubular body provided with inlet and outlet openings at opposite ends thereof, c. providing bladed rotor means for pumping said material through said turboreactor between said inlet and outlet openings thereof, d. heating said turboreactor walls, e. flowing said material against the heated walls of said turboreactor forming said material into a heated, turbulent tubular layer, and f. introducing at least one digesting agent into said turboreactor to intermix with said layer, and g. flowing said layer containing said at least one digesting agent to and out of said discharge opening wherein steps (a.)–(g.) are operated so as to produce cellulose fibers from the vegetable raw materials.

9. A process according to claim 8 wherein the stream of pumpable material flows at a velocity in the range of 20–40 meters/seconds.

10. A process according to claim 8 wherein said turboreactor walls are heated to a temperature in the range of 200–300° C.

11. A process according to claim 8 wherein the mean residence time of the materials within the turboreactor is about 30–60 seconds.

12. A process according to claim 8 comprising the further steps of feeding the material discharged from said turboreactor into a second similar turboreactor and treating said material introduced into said second turboreactor similarly as in said first turboreactor.

13. A process according to claim 8 comprising the further step of introducing a continuous flow of steam at a pressure of 2–5 atmospheres substantially concurrently with said thin tubular and dynamic layer flow in interaction therewith.

* * * * *